US008806827B2

(12) United States Patent
Perttula et al.

(10) Patent No.: US 8,806,827 B2
(45) Date of Patent: Aug. 19, 2014

(54) ROOF ELEMENT

(75) Inventors: Matti Perttula, Helsinki (FI); Janne Tanhuanpää, Loimaa (FI)

(73) Assignee: Rautaruukki Oyj, Helsinki (FI)

( * ) Notice: Subject to any disclaimer, the term of this patent is extended or adjusted under 35 U.S.C. 154(b) by 6 days.

(21) Appl. No.: 12/738,685

(22) PCT Filed: Oct. 30, 2008

(86) PCT No.: PCT/FI2008/050614

§ 371 (c)(1),
(2), (4) Date: Jun. 11, 2010

(87) PCT Pub. No.: WO2009/056683

PCT Pub. Date: May 7, 2009

(65) Prior Publication Data

US 2011/0154767 A1 Jun. 30, 2011

(30) Foreign Application Priority Data

Nov. 1, 2007 (FI) ..... 20075777

(51) Int. Cl.
*E04D 1/00* (2006.01)
*E04D 1/26* (2006.01)
*E04D 3/30* (2006.01)

(52) U.S. Cl.
CPC . *E04D 3/30* (2013.01); *E04D 1/265* (2013.01)
USPC ..... 52/519; 52/555; 52/556; 52/314

(58) Field of Classification Search
USPC ..... 52/554–557, 518–520, 314, 74
See application file for complete search history.

(56) References Cited

U.S. PATENT DOCUMENTS 2,143,166 A * 1/1939 Pattiani ..... 52/553
D253,724 S * 12/1979 Yanoh ..... D25/140

(Continued)

FOREIGN PATENT DOCUMENTS

EP 0 126 719 11/1984
JP 54-105819 A 8/1979

(Continued)

OTHER PUBLICATIONS

Patent Abstract of Japan Publication No. 11124964 A Published May 11, 1999.

(Continued)

*Primary Examiner* — Brian Glessner
*Assistant Examiner* — Brian D Mattei
(74) *Attorney, Agent, or Firm* — Ladas & Parry LLP

(57) ABSTRACT

A shaped roof element (1) for roofs made of elements, the roof element (1) comprising a first and a second side edge (4, 6), an upper edge (8) and a lower edge (10), a profile substantially parallel to the side edges (4, 6) and a series of steps comprising two or more steps (12, 14) extending substantially parallel to the upper and lower edges (8, 10), the steps being produced so that the lower edge (10) forms one of the steps (14). The step (14) on the lower edge (10) is produced in the form of a round bend (20) bending underneath the shaped roof element (1), the profile of the bend corresponding substantially to a profile parallel to the side edges (4, 6) of the shaped roof element (1).

16 Claims, 4 Drawing Sheets

(56) References Cited

U.S. PATENT DOCUMENTS

| | | | | | |
|---|---|---|---|---|---|
| D302,859 | S | * | 8/1989 | Kero | D25/141 |
| 5,131,200 | A | * | 7/1992 | McKinnon | 52/536 |
| 5,283,998 | A | * | 2/1994 | Jong | 52/515 |
| D374,095 | S | * | 9/1996 | Ing | D25/140 |
| 5,685,117 | A | * | 11/1997 | Nicholson | 52/520 |
| 5,881,501 | A | * | 3/1999 | Guffey et al. | 52/90.1 |
| 6,336,303 | B1 | * | 1/2002 | Vandeman et al. | 52/520 |
| 6,494,010 | B1 | * | 12/2002 | Brandon et al. | 52/578 |
| D498,546 | S | * | 11/2004 | Chuang | D25/140 |
| 2007/0144095 | A1 | * | 6/2007 | King | 52/518 |

FOREIGN PATENT DOCUMENTS

| | | | |
|---|---|---|---|
| JP | 9-158402 | A | 6/1997 |
| JP | 9-242267 | A | 9/1997 |
| JP | 11-124964 | A | 5/1999 |
| JP | 11-315620 | A | 11/1999 |
| JP | 2005-194724 | | 7/2005 |

OTHER PUBLICATIONS

Patent Abstract of Japan Publication No. 09158402 A Published Jun. 17, 1997.

Espacenet English abstract of JP 11-315620 A.

Office Action from the JPO dated May 28, 2013 for Application No. 2010-531554.

* cited by examiner

ROOF ELEMENT

BACKGROUND OF THE INVENTION

The invention relates to a shaped roof element according to the preamble of claim 1 and particularly to a roof element for a roof covering, the shaped roof element being manufactured of a plate material, the roof element comprising a first and a second side edge, an upper edge and a lower edge, a profile substantially parallel with the side edges and a series of steps comprising two or more steps extending substantially parallel to the upper and the lower edges, the steps being produced so that the lower edge is one of the steps.

Steel sheet roofs are subject to cut edge corrosion, when precut roof elements joined together to overlap at their border areas become wet. Generally the reason for this is that the borders of the roof elements are not coated, whereby moisture is allowed to penetrate between the sheet and the coating and cause detachment of the coating. Water tends to penetrate between the overlapping roof elements due to capillary force, for example, and other properties of the seam areas, which significantly enhances edge corrosion. In the prior art, attempts have been made to prevent edge corrosion by painting or lacquering the edges of roof elements in different ways. Also seams running parallel to the eaves between successive roof elements in the direction of the roof pane have been formed with the view of preventing water from flowing between the roof elements in the seam area. When different roof elements comprising steps parallel to the eaves are used, the seam area is produced to the vertical portion of the roof element steps, where the wet period is significantly shorter than in seam areas parallel to the surface of the roof elements. In the prior art it has been possible to provide these vertical step portions with different drips by bending the edge of the topmost plate at the seam area away from the vertical portion for preventing water from running between the roof elements. An alternative known method is to provide these vertical portions with different round bends, in which the edge of the roof element is bent out of sight underneath the roof element.

A problem with the above prior art arrangements is that different ways of painting and lacquering the edges are not cost-effective from the manufacturing point of view because of the drying time needed for the paints and the lacquers. Moreover, the paints and lacquers may easily crack and become detached during the installation or use of the roof elements. Although in the prior art seams have been made to vertical portions of roof elements arranged stepwise in the direction of the roof pane, these seams, together with drips, if any, associated with them are not capable of solving the problem of cut edge corrosion these seams are subjected to, because despite its shape, the cut edge of the roof element edge parallel to the eaves is subjected to moisture from the environment. In addition, solutions employing different round bends, in which the edge of a roof element is bent underneath the roof element, create a problem of mechanical abrasion when overlapping roof elements move in relation to one another during installation and normal use. The edge or fold bent as a round end underneath the roof element thus rubs against the plate underneath, thereby damaging its surface and exposing the rubbed area to corrosion.

SUMMARY OF THE INVENTION

It is therefore an object of the invention to provide a roof element that allows the above problems to be solved. The object of the invention is achieved by a shaped roof element according to the characterizing part of claim 1, the roof element being characterized in that the vertical profile of the step provided at the lower edge substantially corresponds to the profile shape parallel to the side edges of the shaped roof element.

The preferred embodiments of the invention are disclosed in the dependent claims.

The invention is based on preventing corrosion at the cut edge of the shaped roof element by bending the lower edge of the roof element in such a way that it is not exposed to edge corrosion and does not cause problems of abrasion with another similar shaped roof element. The shaped roof element made of plate material, which comprises a first and a second side edge, an upper and a lower edge, and which shaped roof element is stepped by two or more steps substantially parallel to the upper and lower edge, has a step provided at the lower edge thereof in such a way that the lower edge of the shaped roof element forms a portion bent downward from the surface of the shaped roof element. The step is produced to the lower edge of the shaped roof element by bending the edge downward. According to the present invention the lower edge is bent further underneath the shaped roof element to provide the lower edge with round bend extending downward and underneath the upper surface of the shaped roof element. Moreover, the step and/or the round bend at the lower edge are produced in such a way that their shape and profile substantially correspond to the profile aligned with the side edges of the shaped roof element. In other words, the step or round bend provided at the lower edge has a wavelike profile parallel to the side edges, the profile corresponding to a typical wavelike profile of a shaped roof covering.

An advantage of the method and system of the invention is that since the cut edge of the lower edge is bent underneath the roof element, it is not visible and exposed to environmental corrosive conditions. Instead, it is protected underneath the roof element. In addition, this allows the joint and the seam area between successive roof elements in the direction of the roof pane to be implemented to a vertical surface, on which water is allowed to flow away from the seam area. Moreover, the seam will have an excellent outer appearance, because it is not on the surface of the roof element but at the edge and the step, whereby even a roof made of element pieces such as these looks uniform. In addition, a shaped roof element provided with a profile shape parallel to the side edges and with steps transverse in relation to the side edges stiffens the roof element in two directions, whereby it does not bend and move easily under load. Consequently, overlapping shaped roof elements do not move easily with respect to each other and thereby do not cause abrasion either at the seam on the lower edge between these overlapping shaped roof elements. In that case in particular the stiffening caused by the profiling prevents the upper plate from rubbing against the lower plate when the upper plate is subjected to a load. Moreover, the shape of the roof element together with the profile shape of the lower edge and the round bend thereof enable the roof elements to be positioned in connection with their mounting without having to slide the plates against each other, which further reduces abrasion between the plates. In addition, the profile shape of the roof element and the lower edge reduce reciprocal sliding of superimposed overlapping plates caused by thermal expansion.

BRIEF DISCLOSURE OF THE FIGURES

In the following the invention will be disclosed in greater detail with reference to preferred embodiments and the accompanying drawings, in which FIG. 1 depicts a roof element;

DETAILED DISCLOSURE OF THE INVENTION

Figure 1:
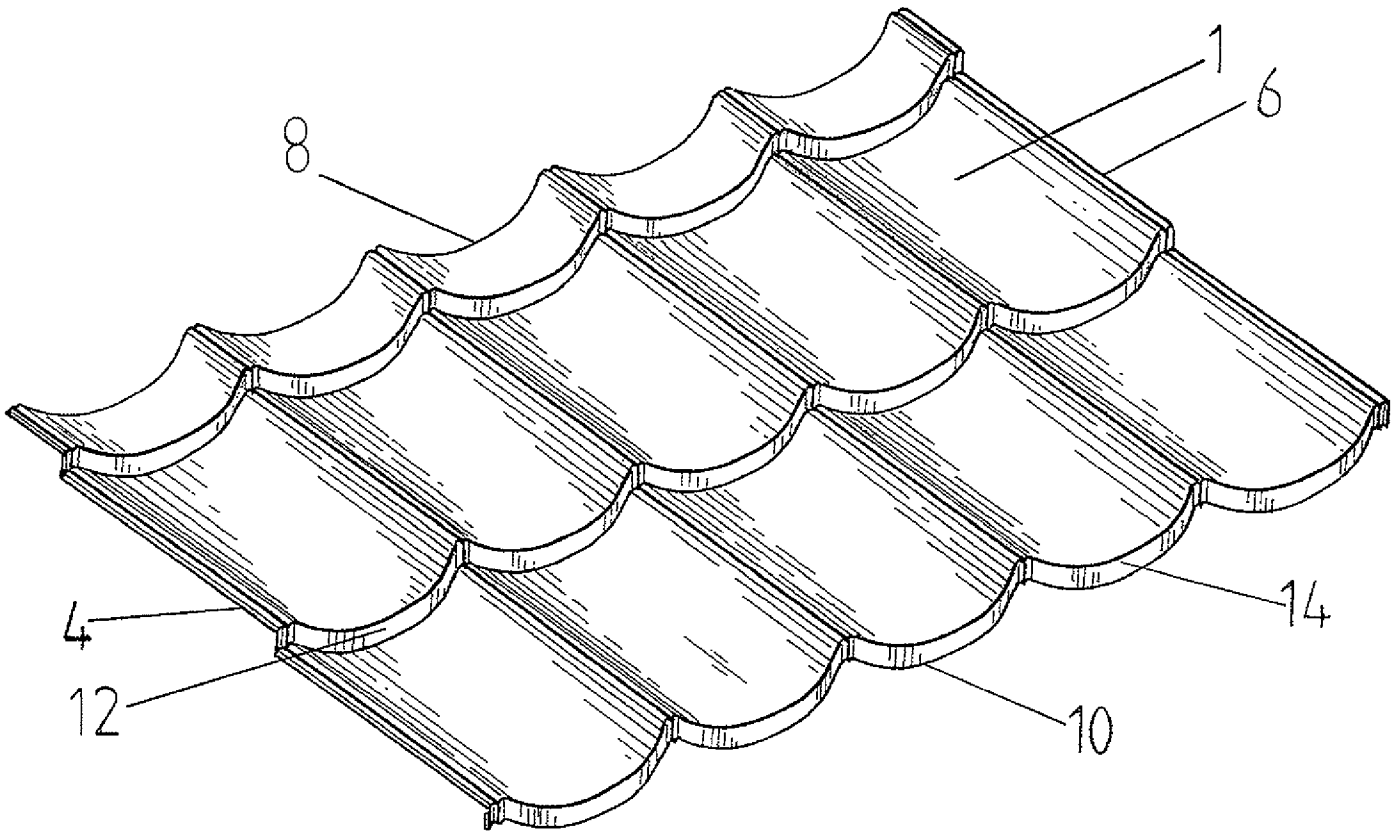

Reference is made to FIG. 1, which shows a shaped roof element 1 manufactured of a plate material, such as steel sheet or a similar plate material. The shaped roof element 1 may thus consist of plate material provided with a paint coating, stone chip coating and/or embossing. The roof element 1 comprises a first and a second side edge 4, 6, an upper edge 8 and a lower edge 10. In addition, the roof element 1 is stepped substantially parallel to the upper and the lower edges 8, 10 by two or more steps 12, 14. As shown in FIG. 1, in the present invention the lower edge 10 forms one step 14 of the roof element or at least a portion of one step. In the case shown in FIG. 1 the roof element 1 is a shaped roof element comprising a profile shape substantially parallel to the side edges 4, 6. The shaped roof element 1 may also comprise a profile transverse to the side edges 4, 6 or a profile parallel to and transverse to the side edges 4, 6. In the case of FIG. 1 the profile parallel with the side edges 4, 6 is implemented as a wave-like profile that extends transversally in relation to the steps 12 and 14. The shaped roof element 1 may be implemented as a single element in a roof made of elements or as a shaped roof element extending along the entire length of the roof pane.

Figure 2A:
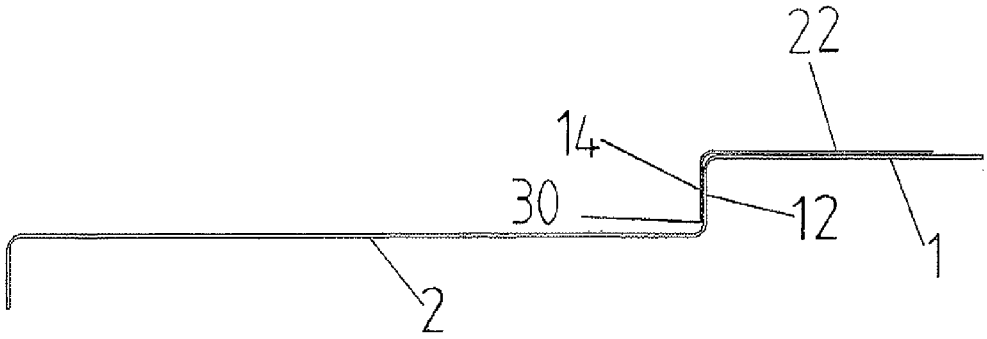
FIGS. 2A, 2B and 2C depict prior art bends of lower edges of roof elements.
Figure 2B:
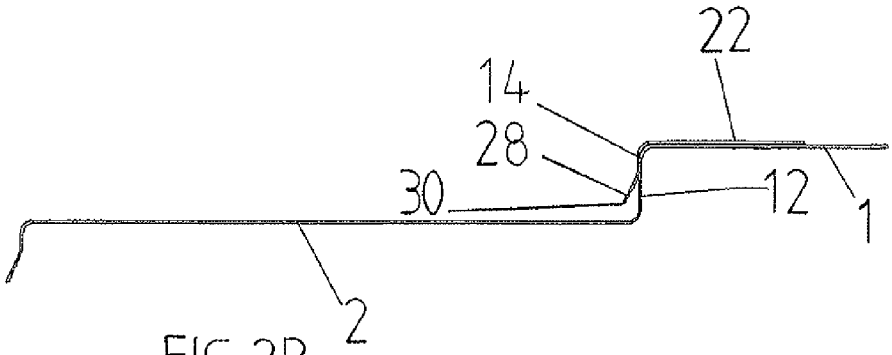
Figure 2C:
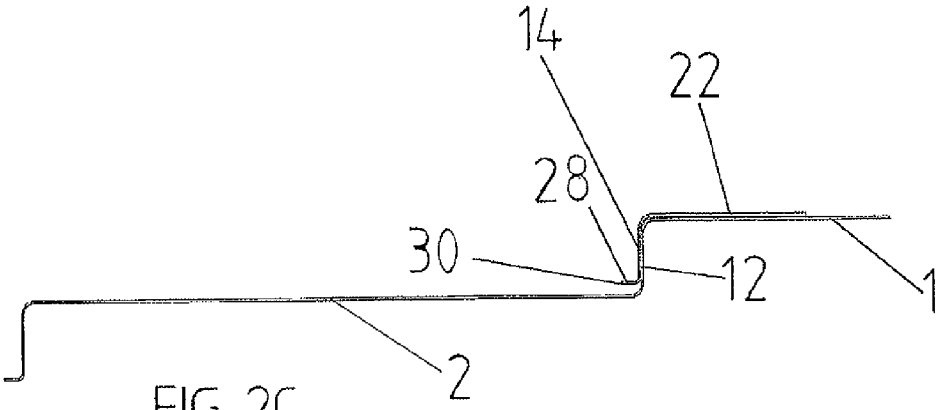

FIGS. 2A, 2B and 2C illustrate typical prior art methods for forming the lower edge 10 of the roof element 1. In the case of FIG. 10 the lower edge 10 is simply bent to extend vertically downward from the surface 22 of the roof element and in relation to the surface 22 of the roof element so that the lower edge 10 forms a step. A joint between two successive corresponding roof elements 1, 2 is thus made by setting the inner surface of the bent lower edge 10 against the step 12 of the other roof element 1, whereby the seam between these roof elements 1, 2 is formed on a vertical surface at the step 12 of the roof elements 2, as shown in FIG. 2A. In this case the cut edge 30 of the lower edge 10 is, however, exposed to moisture originating from the environment. Although the seam that the lower edge 10 of the roof element and the cut edge 30 form with the second roof element 2 is on a vertical surface, where the cut edge 30 remains wet for a shorter period of time than on a horizontal surface, the cut edge 30 is exposed and prone to cut edge corrosion, which may penetrate between the roof element 1 and the coating formed thereon and thereby detach the coating. Moreover, moisture penetrating, due to capillary phenomenon, for example, between the roof elements 1, 2 at the seam area in the vicinity of the cut edge extends the wet period and thereby enhances development of cut edge corrosion.

FIGS. 2B and 2C show variations of the embodiment of FIG. 2A. In FIGS. 2B and "C the lower edge 10 of the roof element is provided not only with a step 14 but also with a bent drip 28. In FIG. 2B the drip is bent to a vertical portion of the lower edge 10 in such a way that the lower edge 10 extends diagonally at the vicinity of the cut edge 30 away from the step 12 of the second roof element 2, the cut edge 30 thus being detached from the step 12. In FIG. 2C the lower edge 10, in turn, is bent away from the step 21 of the second roof element 2 in such a way that the lower edge 10 extends in the vicinity of the cut edge 30 away from the step 22 parallel to the surface 22. In these embodiments the cut edge 30 is detached from other surfaces also at the seam area between the two roof elements 1, 2, whereby no water remains standing at the cut edge 30. However, the cut edge 30 is continuously exposed to moisture originating from the environment and to other unfavourable conditions causing cut edge corrosion.

Figure 3A:
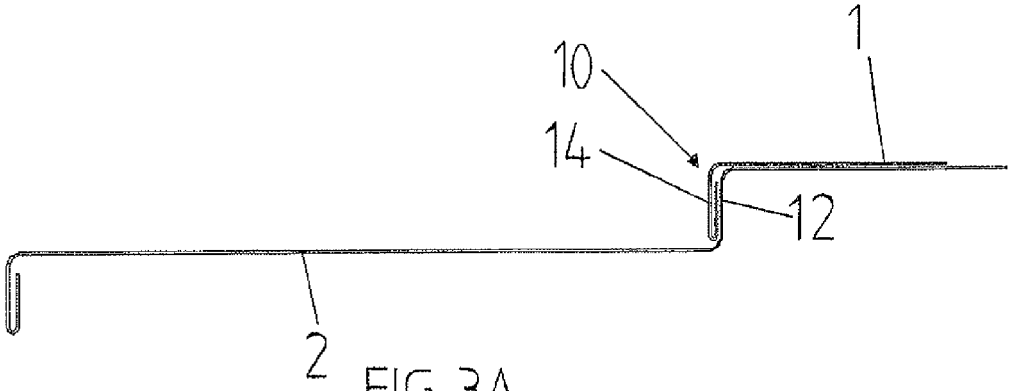
FIGS. 3A and 3B illustrate an embodiment of a roof element of the invention.
Figure 3B:
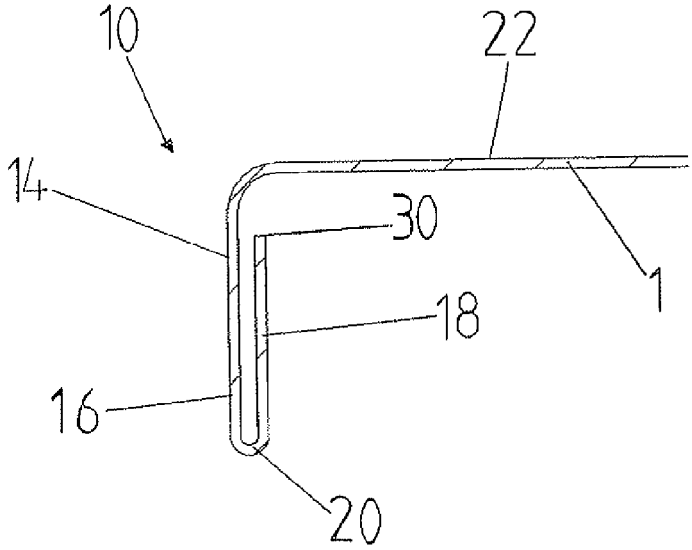
Figure 4:
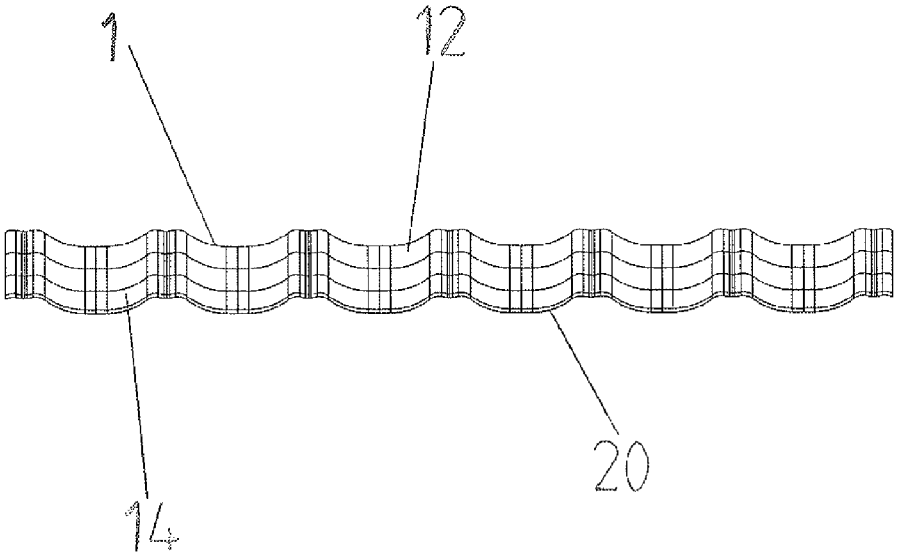
FIG. 4 is a front view of a roof element of the invention.

FIGS. 3A and 3B, in turn, show an embodiment of the present invention. According to the invention the lower edge 10 of the roof element, which forms a step 14, is provided with a round bend 20 in such a way that the cut edge 30 extends below the roof element 1. FIG. 3B is a detailed view of an embodiment of the invention. The roof element 1, which comprises a surface 22 forming the roof surface, is bent downward at its lower edge 10 in relation to the surface 22 to form the step 14 to the lower edge 10. As shown in FIG. 3B, the lower edge 10 of the roof element 1 is bent substantially along the entire length of the lower edge 10 to extend downward from the surface of the roof element 1 for a predetermined portion 16. The lower edge 10 is also provided with a round bend 20 in such a way that the lower edge 10 extends further upward on portion 18 below the roof element 1, as shown in FIG. 3B. Although this embodiment shows that both the downward extending portion 16 and the upward extending portion are vertical in relation to the surface 22 of the roof element 1, they may also extend at an angle in relation to the surface 22 depending on the general orientation of the steps 12 and 14 of the roof element 1 in relation to the surface 22. An essential aspect, however, is that the lower edge 10 is provided with a round bend 20 in such a way that the vertical portions 16 and 18 extending downward and upward extend side by side and preferably substantially parallel. If desired, the upward extending portion 18 may be bent to extend toward the downward extending portion 16 for example so that the cut edge 30 presses against the portion 16. With this arrangement the cut edge 30 remains always hidden underneath the roof element 1 and is not exposed at the seam area between the roof elements but protected underneath the roof element 1. The step 14 provided to the lower edge 10 is formed as a round bend 20 bent underneath the shaped roof element 1 and having a shaped profile. In other words, the step 14 forming the lower edge 10 and the round bend 20 have a shaped profile. In that case the step 14 provided on the lower edge 10 may comprise a profile in the longitudinal and/or height direction thereof, the profile of the step 14 provided to the lower edge 10 in the longitudinal and/or height direction thereof being formed in the shape of a wave. In a preferred case the height direction profile of the step 14 provided to the lower edge 10 corresponds substantially to the wave-like profile provided parallel to the side edges 4, 6 of the shaped roof element 1. In certain cases the profile of the step 12 and/or the lower edge 10 and that of the step 14 provided thereto is substantially straight in a direction transverse to the side edges 4, 6. In other words, the step 14 provided to the lower edge 10 preferably has a wavelike profile similar to that of the shaped roof element 1. In addition, the lower edge 10 may be implemented in a wavelike shape in the longitudinal direction thereof, whereby the step 14, and possibly also the step 12, is provided with a wavelike shape in a direction transverse to the longitudinal direction and to the side edges 4, 6 thereof. In that case it is further possible to provide the step 14 with a wavelike shape both in the length and height direction thereof to produce a waveform. Alternatively, the step 12 and/or the step 14 provided to the lower edge 10 is substantially straight in its longitudinal direction, transverse to the side edges 4, 6. FIG. 4 presents a front view of this kind of shaped roof element 1. FIG. 4 shows a height profile of steps 12 and the step 14 forming the front edge, the profile corresponding substantially to the profile parallel to the side edges of the shaped roof element 1.

The upward extending portion 18 of the lower edge 10 is substantially parallel with the downward extending portion 16, the lower edge 10 being thus provided with a U-shaped cross-section that opens upward in the longitudinal direction thereof and underneath the roof element 1. Alternatively, the upward extending portion 18 of the lower edge 10 extends diagonally upward toward the downward extending portion 16 to provide an overbend to the round bend 20. Alternatively, the upward extending portion 18 of the lower edge 10 extends diagonally upward away from the downward extending portion 16. However, because of the joint between two roof elements, it is not advantageous for the upward extending portion 18 to extend away from the downward extending portion 16, because in that case the round bend 20 protrudes away from the step 12 of the lower roof element. The bending radius in the round bend 20 between the downward extending portion 16 and the upward extending portion 18 is 1 to 5 times the thickness of the plate-like material of the roof element 1. Preferably the bending radius is 1 to 2.5 times the thickness of the plate-like material of the roof element 1 and most preferably 1.5 to 2 times the thickness of the plate-like material of the roof element 1. With smaller bending radiuses the coating provided on the roof element 1 becomes easily damaged, which may cause corrosion and other problems. Then again, with greater bending radiuses the thickness of the round bend increases unnecessarily.

Further, the round bend 20 may be filled with a sealant or a filling material, if desired, to prevent the formation of a water pocket. The filling may be carried out using a foamy or solid filling material, for example. Alternatively, or additionally, one or more holes or openings are provided to the bottom of the round bend 20 to remove water from the round bend 20.

The lower edge of the roof element 1 may be cut in such a way that the lower edge is straight, or, that the height and/or length direction of the lower edge presents a waveform, or the like, corresponding to that of the profile of the roof element or the steps 12 of the roof element. It is also possible to cut the upper edge of the roof element straight or into a waveform corresponding to that of the roof element profile or the steps 12. The side edges are preferably straight. In addition, the lower edge 10 may be bent to provide different folds and/or stiffeners (not shown) that enhance the stiffness of the lower edge 10 and the roof element 1. In complex shaped roof coverings the bending of the lower edge 10 may also require lightening cuts (not shown) to the lower edge 10 for producing the round bend of the invention, because the plate-like material is required to both stretch and to compress in areas close to one another.

FIG. 3A further shows a joint between two successive roof elements 1 and 2 in the direction of the roof pane. The lower edge 10 of the roof element 1 provided with the step 14 having a round bend 20 of FIG. 3B is positioned to overlap on a predetermined distance with a second roof element 2 placed underneath it, against the step 12, as shown in FIG. 3A. The upward extending portion 18 of the lower edge 10 of the roof element 1 thus sets against the front surface of the step 12 of the roof element 2 and the cut edge 30 remains hidden and covered between the roof elements 1 and 2 and hence is not exposed to environmental effects, which prevents cut edge corrosion from occurring. The seam between the roof elements 1 and 2 thus sets onto a vertical surface, which further prevents edge corrosion and hides the seam, thereby improving the outer appearance of the product, because the outer appearance of the roof remains unchanged also at the seam area 15.

In addition to the above, according to the invention the upper edge 8 and/or second or both side edges 4, 6 of the shaped roof element 1 are provided with a round bend, the upper edge 8 and/or the second or both side edges 4, 6 being bent underneath the shaped roof element 1. This allows also edge corrosion to be prevented at these other edges. In addition, the steps 12 or the step 14 on the lower edge 10 are provided with one or more location recesses for positioning a fastening screw.

A person skilled in the art will find it apparent that as technology advances the basic idea of the invention may be implemented in various ways. Therefore the invention and its embodiments are not restricted to the examples described above but may vary within the scope of the claims.

The invention claimed is:

1. A first roof element comprising:

(1) a plate material having first and second side edges, an upper edge and a lower edge; the plate material forming the roof element with at least an upper surface, a lower surface, a first step disposed between the upper surface and the lower surface and extending transversely therefrom, and a second step disposed at an end of the lower surface and extending transversely therefrom;

(2) wherein each of the upper and lower surfaces extends in a lengthwise direction that is substantially parallel to that of the upper and lower edges and in a widthwise direction that is substantially parallel to that of the first and second side edges;

(3) wherein the second step comprises a first step portion that extends downwardly from the lower surface, a second step portion that extends upwardly toward the lower surface and a round bend disposed between the first step portion and the second step portion, the second step portion being disposed underneath the lower surface and comprising the lower edge; and (4) wherein the plate material has a profile in the shape of a wave in a height direction when viewed from a front thereof and is constructed and arranged such that the first roof element is disposable in an overlapping arrangement with a second roof element of the same shape wherein (a) (i) the lower surface of the first roof element lies atop and contacts the upper surface of the second roof element, (ii) the first step portion of the second step of the first roof element overlaps a surface of the first step of the second roof element and is uniformly proximal to the surface of the first step of the second roof element along an entire width of the overlap, (iii) the second step portion of the second step of the first roof element is sandwiched between the first step portion of the second step of the first roof element and the surface of the first step of the second roof element and (iv) the lower edge of the first roof element is disposed beneath the lower surface of the first roof element, whereby in the overlapping arrangement the lower edge of the first roof element is protected from the environment and movement between the first and second roof elements is inhibited in a first direction, and (b) the waves of the respective profiles of the first and second roof elements are aligned such that, in the overlapping arrangement, movement between the first and second roof elements is inhibited in a second direction that is different from the first direction.

2. The first roof element according to claim 1, wherein the round bend of the second step has a profile in the shape of a wave in the lengthwise direction when viewed from above.

3. The first roof element according to claim 1, wherein the first step and the second step extend perpendicularly from the lower surface and the upper surface respectively.

4. A kit comprising the first roof element according to claim 1 and a second roof element of the same shape, wherein the first and second roof elements are disposed in the overlapping arrangement.

5. The first roof element according to claim 1, wherein each of the upper and lower surfaces has a side edge that is straight.

6. The first roof element according to claim 5, wherein each of the upper and lower surfaces has the profile in the shape of a wave in the height direction, said profile comprising a plurality of crests and troughs, the side edge of each of the upper and lower surfaces being disposed at one of the crests of the profile.

7. The first roof element according to claim 1, wherein each of the upper and lower surfaces has the profile in the shape of a wave in the height direction, said profile comprising a plurality of crests and troughs, and wherein each of the upper and lower surfaces has a side edge that is disposed at one of the crests of the profile.

8. The first roof element according to claim 1, wherein the lower edge of the plate material has the profile in the shape of a wave in a height direction.

9. The first roof element according to claim 1, wherein the second step portion of the first roof element that extends upwardly toward the lower surface is substantially parallel to the first step portion that extends downwardly from the lower surface with the first step portion, second step portion and round bend there between having a cross section of U shape.

10. The first roof element according to claim 1, wherein the round bend has a bending radius of 1 to 5 times the thickness of the plate material.

11. The first roof element according to claim 1, wherein the plate material forms the roof element with a further surface in addition to the upper surface and lower surface with the upper surface being disposed between the further surface and the lower surface, the plate material comprising a further step disposed between the further surface and the upper surface.

12. The first roof element according to claim 1, wherein the plate material is coated with paint or stone chip.

13. The first roof element according to claim 1, wherein the plate material is embossed.

14. The first roof element according to claim 1, wherein the first step and the second step have corresponding profiles in the lengthwise direction when viewed from above, said corresponding profiles being in the shape of a wave.

15. The first roof element according to claim 1, wherein the round bend has a bending radius of 1 to 2.5 times the thickness of the plate material.

16. The first roof element according to claim 1, wherein the round bend has a bending radius of 1.5 to 2 times the thickness of the plate material.

* * * * *